US011431120B2

(12) United States Patent
Hsiao et al.

(10) Patent No.: US 11,431,120 B2
(45) Date of Patent: Aug. 30, 2022

(54) TERMINAL MODULE AND MATING ASSEMBLY THEREOF

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Shih-Wei Hsiao, New Taipei (TW); Yu-San Hsiao, New Taipei (TW); Yen-Chih Chang, New Taipei (TW); Meng Liu, Kunshan (CN); Jhih-Yao Jiang, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/200,877

(22) Filed: Mar. 14, 2021

(65) Prior Publication Data

US 2021/0288429 A1 Sep. 16, 2021

(30) Foreign Application Priority Data

Mar. 16, 2020 (CN) ..... 202010180866.0

(51) Int. Cl.
*H01R 13/28* (2006.01)
*H01R 13/6473* (2011.01)
*H01R 13/631* (2006.01)

(52) U.S. Cl.
CPC ..... *H01R 13/28* (2013.01); *H01R 13/631* (2013.01); *H01R 13/6473* (2013.01)

(58) Field of Classification Search
CPC ..... H01R 13/28; H01R 13/33; H01R 13/26; H01R 13/20; H01R 13/631; H01R 13/6315; H01R 13/6473; H01R 24/40
USPC ..... 439/284
See application file for complete search history.

(56) References Cited

U.S. PATENT DOCUMENTS 4,455,056 A * 6/1984 Herrmann, Jr ..... H01R 13/53 439/732
5,167,528 A * 12/1992 Nishiyama ..... H01R 43/24 439/284
5,299,939 A * 4/1994 Walker ..... H01R 13/33 439/74
5,575,674 A * 11/1996 Davis ..... H01R 24/84 439/573

(Continued)

FOREIGN PATENT DOCUMENTS

CN 104167620 8/2017

*Primary Examiner* — Harshad G Patel
(74) *Attorney, Agent, or Firm* — Ming Chieh Chang; Wei Te Chung

(57) ABSTRACT

A terminal module includes: a conductive terminal to be contacted and cooperated with a mating terminal, the conductive terminal including a base and a mating end at a front of the base, the mating end including a contact portion to be contacted and cooperated with the mating terminal and a front end portion at a front end of the contact portion; and a plastic part, wherein the plastic part is arranged at the front end portion so that a gap between the contact portion of the conductive terminal and the mating terminal is less than 0.1 mm after cooperated.

16 Claims, 8 Drawing Sheets

(56) References Cited

U.S. PATENT DOCUMENTS

| | | | | |
|---|---|---|---|---|
| 6,540,529 | B1 * | 4/2003 | Yu | H01R 13/28 439/74 |
| 10,581,190 | B1 | 3/2020 | Te | |
| 2001/0039136 | A1 * | 11/2001 | Vicamini | H01R 13/28 439/292 |
| 2010/0167569 | A1 * | 7/2010 | Stoner | H01R 13/28 439/284 |
| 2012/0088386 | A1 * | 4/2012 | Guo | H01R 12/73 439/284 |
| 2015/0311610 | A1 * | 10/2015 | Little | H01R 12/707 439/284 |
| 2018/0198227 | A1 * | 7/2018 | Mundt | H01R 13/26 |

* cited by examiner

TERMINAL MODULE AND MATING ASSEMBLY THEREOF

BACKGROUND OF THE INVENTION

1. Field of the Invention

The present invention relates generally to a terminal module and a mating assembly with the terminal module, and more particularly to a terminal module and a mating assembly with impedance matching designs.

2. Description of Related Arts

China patent No. 104167620 discloses a conductive terminal which includes a contact portion and a front end portion located at a front of the contact portion. The front end portion is a guide portion that overhangs in a direction opposite to a mating direction. The overhanging guide portion causes the front end of the conductive terminal to form a stub effect, which affects the integrity of the signal transmission. Therefore, an improved terminal module is needed.

An improved terminal module and a mating assembly with the terminal module are desired.

SUMMARY OF THE INVENTION

A main object of the present invention is to provide terminal module and a mating assembly that achieve impedance matching after mating with a mating terminal.

To achieve the above-mentioned object, a terminal module comprises: a conductive terminal to be contacted and cooperated with a mating terminal, the conductive terminal including a base and a mating end at a front of the base, the mating end including: a contact portion to be contacted and cooperated with the mating terminal and a front end portion at a front end of the contact portion; and a plastic part, wherein the plastic part is arranged at the front end portion so that a gap between the contact portion of the conductive terminal and the mating terminal is less than 0.1 mm after the conductive terminal is mated to the mating terminal.

To achieve the above-mentioned object, a mating assembly comprises: a terminal module including a plastic part and a conductive terminal having a base and a mating end at a front of the base, the mating end including: a contact portion and a front end portion at a front end of the contact portion; and a mating terminal module matched with the terminal module, the mating terminal module including a mating terminal to be contacted and cooperated with the conductive terminal, wherein the plastic part is arranged at the front end portion, so that the gap between the contact portion of the conductive terminal and the mating terminal is less than 0.1 mm after the conductive terminal is mated to the mating terminal.

Compared to the prior art, the plastic part of the terminal assembly of the present invention is arranged at the front end of the conductive terminal, so that the gap between the contact portion of the conductive terminal and the mating terminal after mating is less than 0.1 mm, thereby solve the impact of the capacitance effect on impedance matching during high-speed signal transmission.

DETAILED DESCRIPTION OF THE PREFERRED EMBODIMENT

Figure 1:
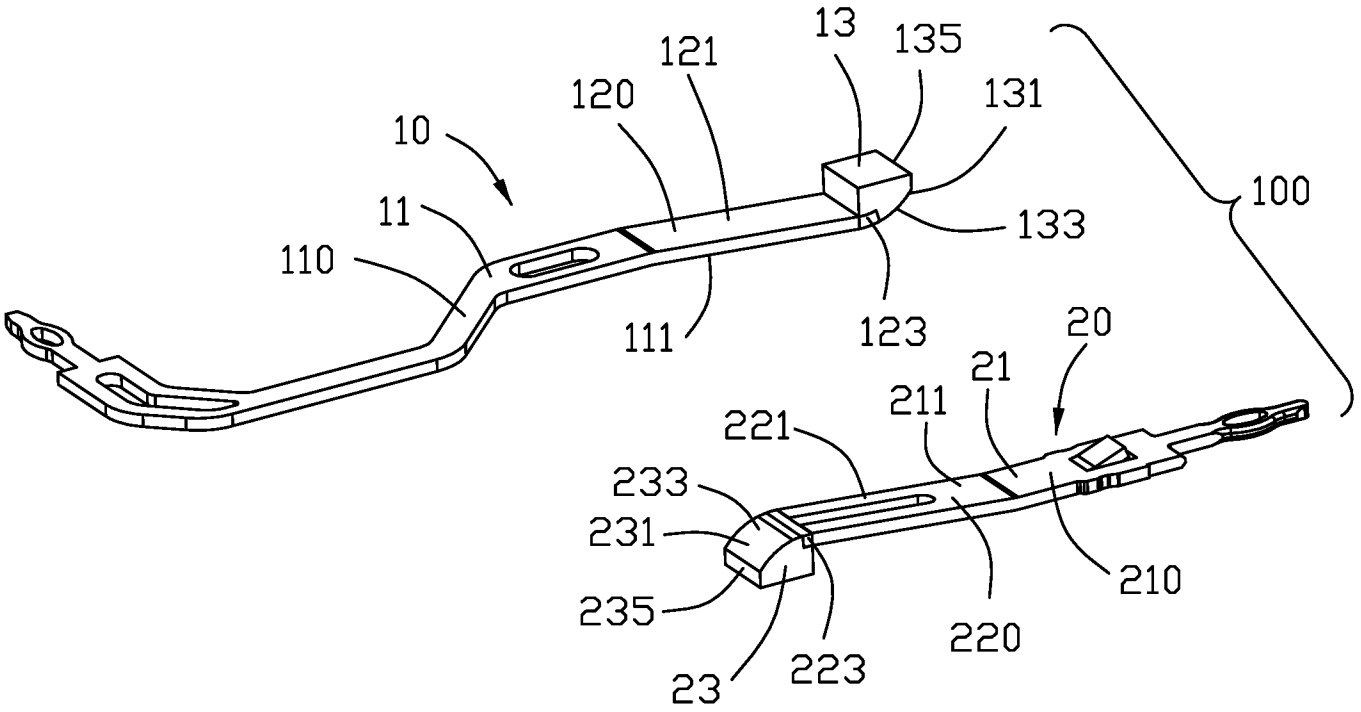
FIG. 1 is a perspective view of a mating assembly in accordance with the present invention before mating.
Figure 2:
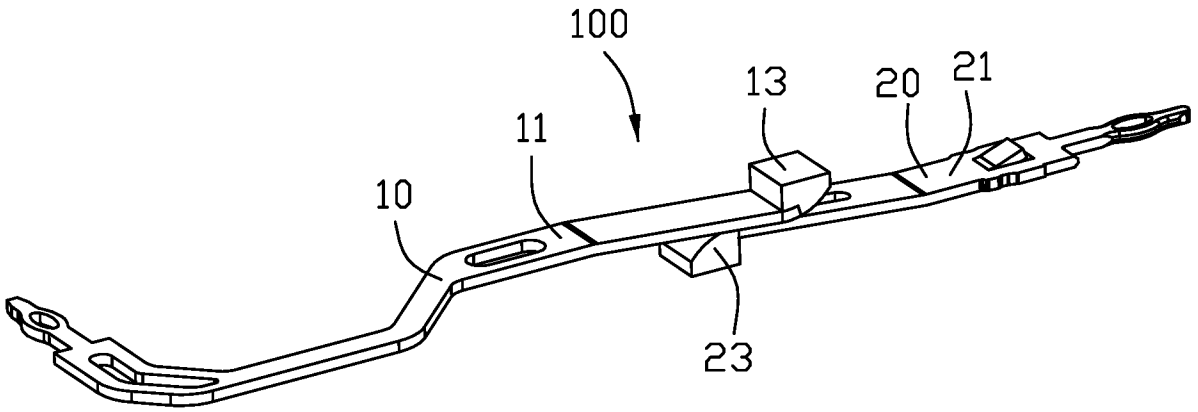
FIG. 2 is a perspective view the mating assembly after mating in FIG. 1.
Figure 3:
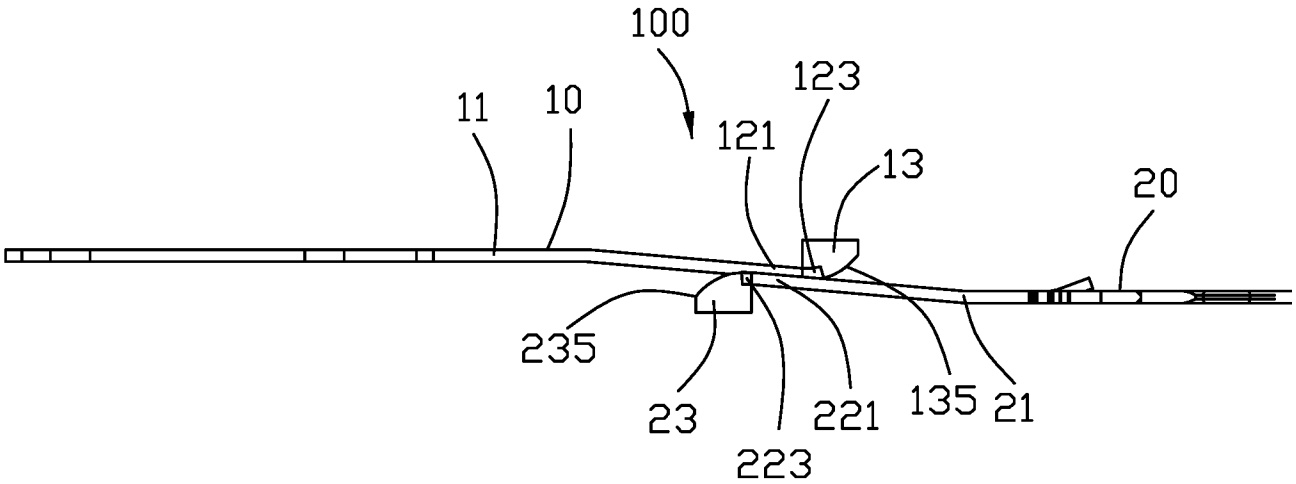
FIG. 3 is a front view of the mating assembly in FIG. 2.
Figure 4:
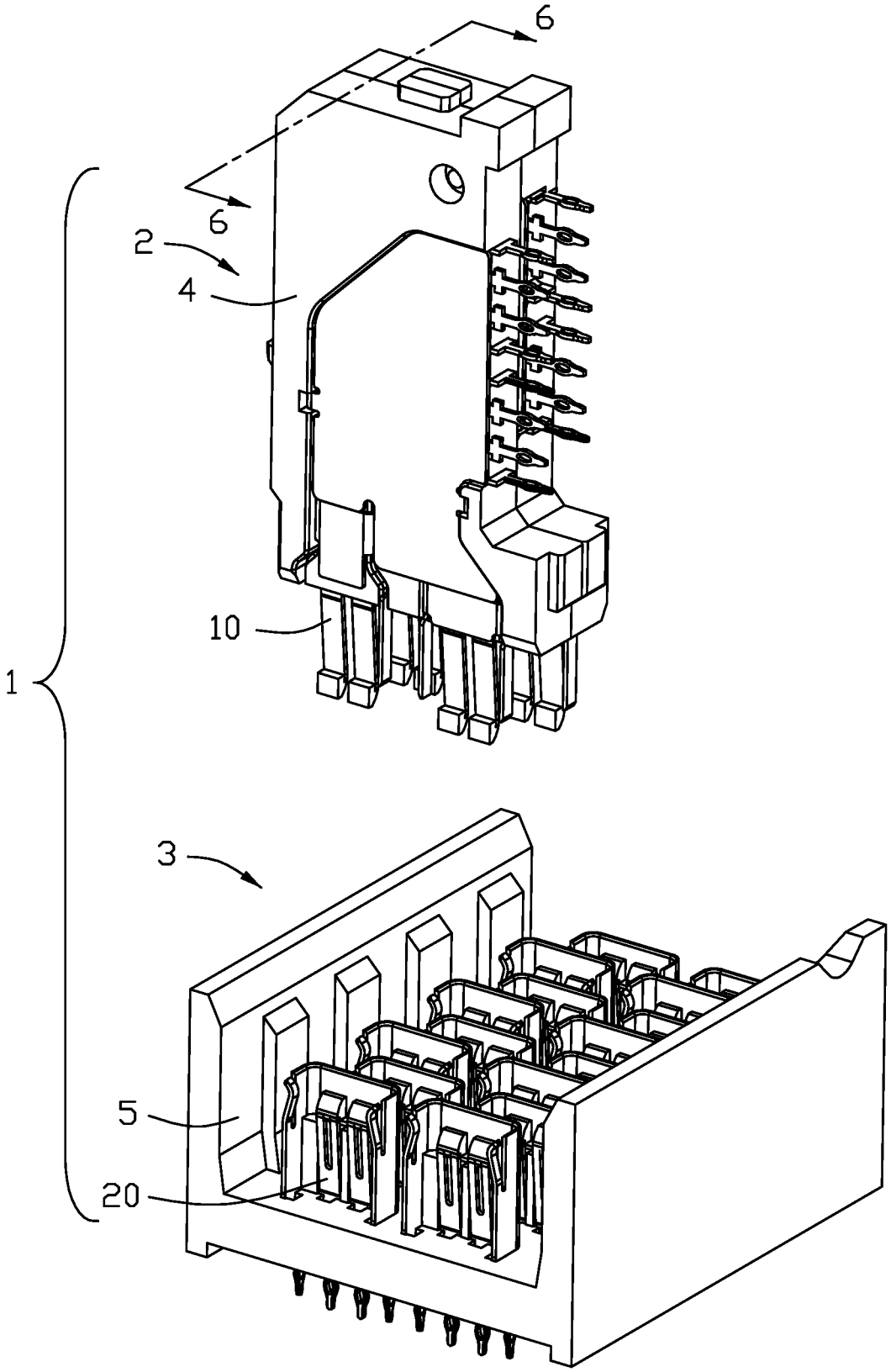
FIG. 4 is a perspective view of a connector assembly with the mating assembly as shown in FIG. 1 in unmated state.
Figure 5:
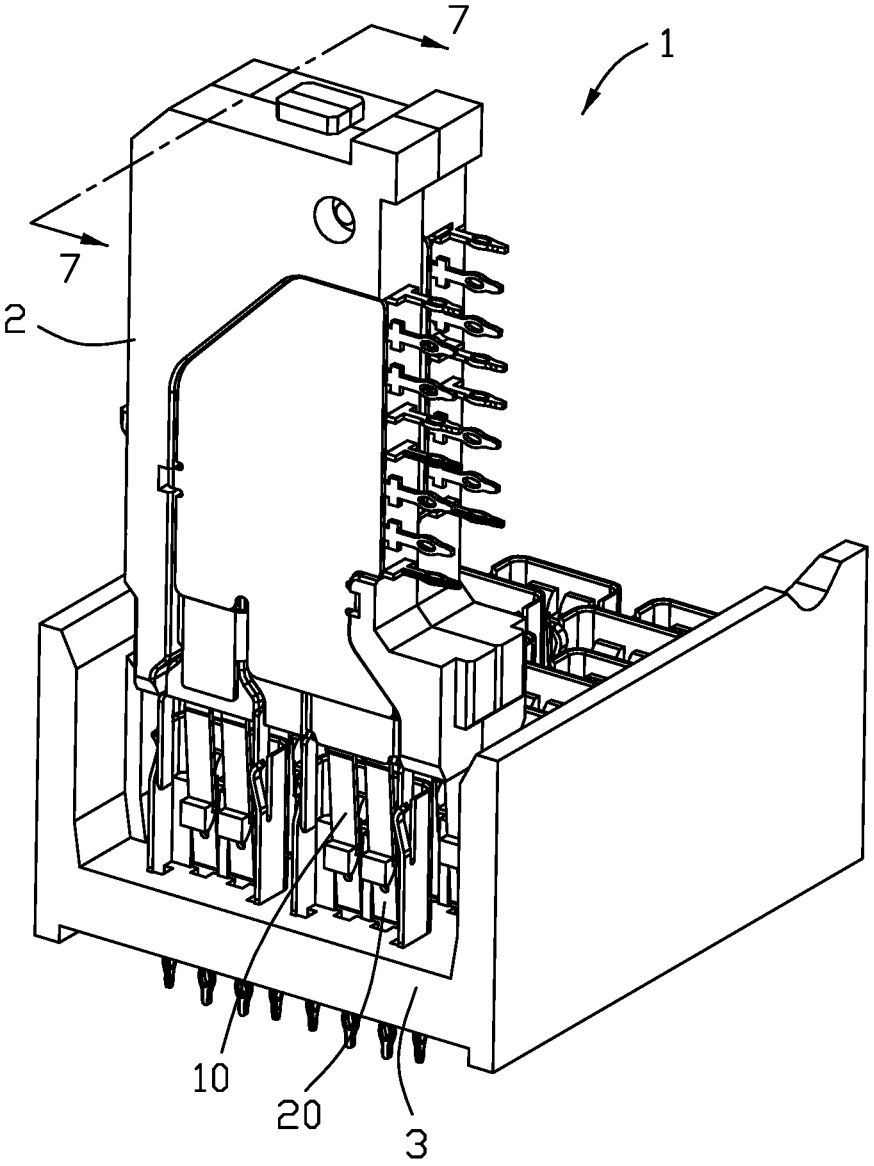
FIG. 5 is a perspective view of a connector assembly with the mating assembly as shown in FIG. 1 in mated state.
Figure 6:
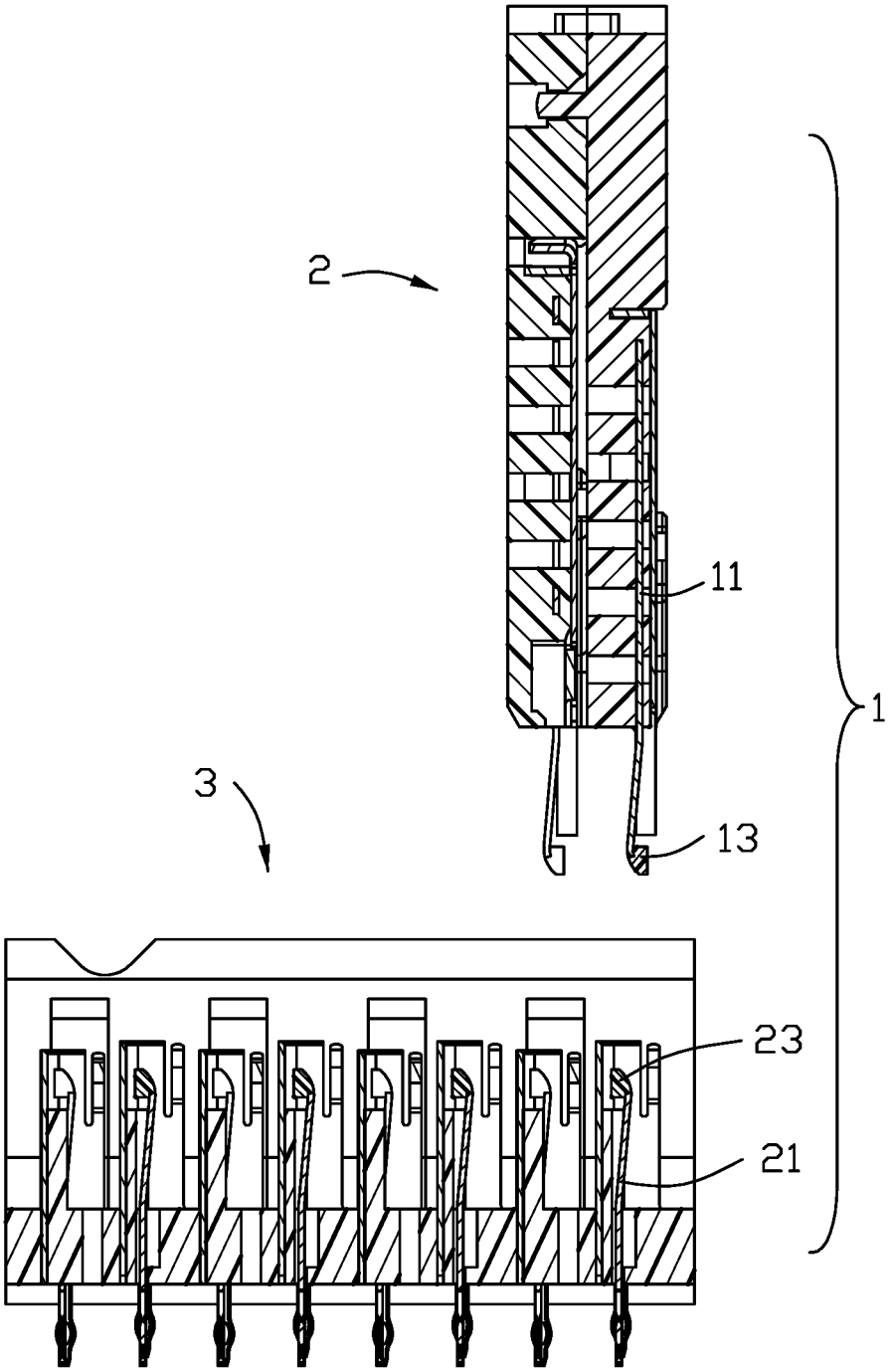
FIG. 6 is a cross-sectional view along line 6-6 of the connector assembly in FIG. 4.
Figure 7:
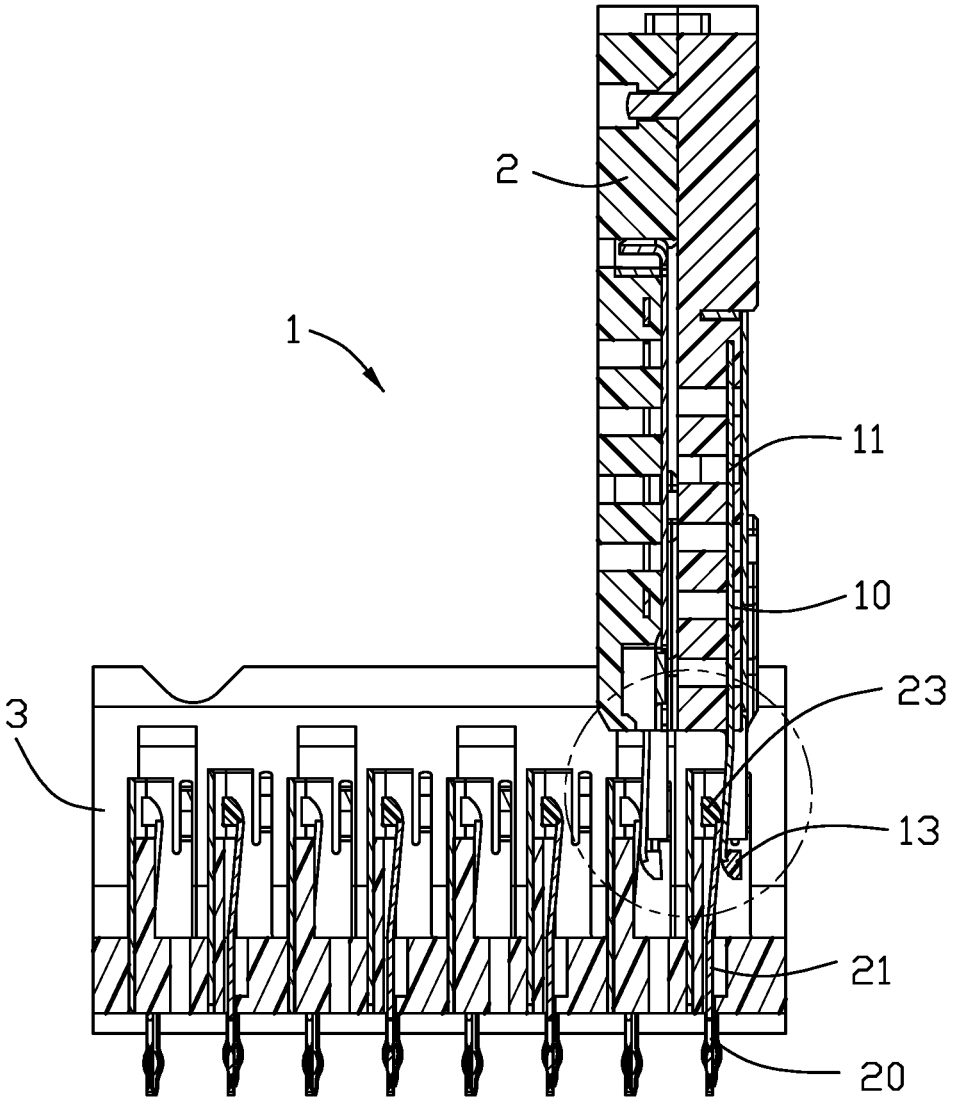
FIG. 7 is a cross-sectional view along line 7-7 of the connector assembly in FIG. 5.
Figure 8:
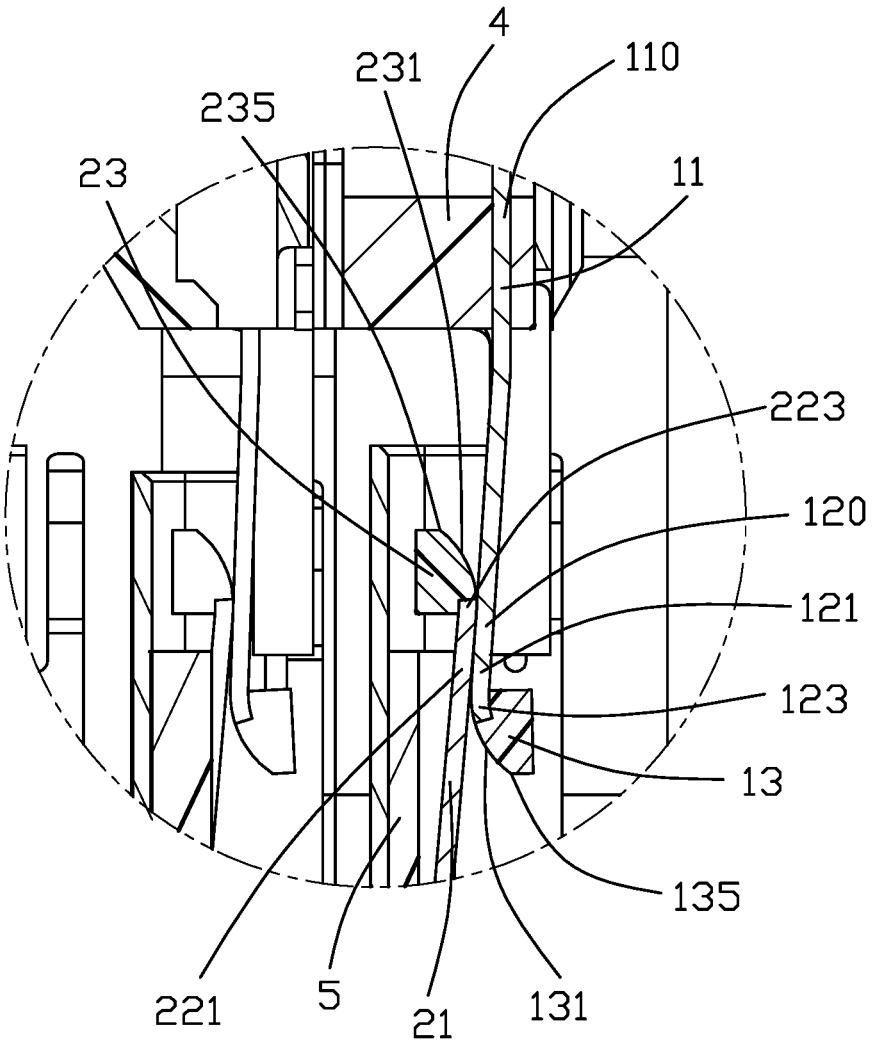
FIG. 8 is a partial enlarged view of the connector assembly in FIG. 7.

Referring to FIGS. 1-3, a mating assembly 100 of the present invention comprises a terminal module 10 and a mating terminal module 20 matched with the terminal module 10. The terminal module 10 includes a conductive terminal 11 and a plastic part 13. The mating terminal module 20 includes a mating terminal 21 and a mating plastic part 23.

Referring to FIGS. 4-8, a connector assembly 1 with the mating assembly 100 of the present invention is shown. The connector assembly 1 includes a first connector 2 and a second connector 3 mated with the first connector 2 (only part of the second connector is shown). The first connector 2 includes a first insulating body 4 and a plurality of terminal modules 10 hold on the first insulating body 4. The second connector 3 includes a second insulating body 5 and a mating terminal module 20 hold on the second insulating body 5. After the first connector 2 is mated with the second connector 3, the conductive terminal 11 and the corresponding mating terminal 21 are contact and cooperate with each other. In the present invention, the mating direction of the two connectors is regarded as the front and rear direction, and the mating direction of the conductive terminal 11 and the mating terminal 21 is defined as the cooperating direction.

Referring to FIGS. 1-8, The conductive terminal 11 includes a base 110 held in the first insulating body 4 and a mating end 120 located in the front of the base 110. The mating end 120 includes a contact portion 121 capable of contacting and cooperating with the mating terminal 21 and a front end portion 123 located at the front of the contact portion 121. In the front and rear direction of the conductive terminal 11, the size of the contact portion 121 is at least twice the size of the front end portion 123. The front end portion 123 is warped from the front end of the contact portion 121 in a direction opposite to the cooperating direction. The plastic part 13 is disposed on the front end portion 123. The front end 135 of the plastic part 13 extends forward beyond the foremost end of the front end portion 123 of the conductive terminal 11. The plastic part 13 is integrally formed on the front end portion 123. Of course, the plastic part 13 can also be formed first and then assembled on the front end portion 123. The conductive terminal 11 is an elastic terminal, and the contact portion 121 thereof is cooperated with the mating terminal 21 by elastic abutment. The plastic part 13 includes a guiding portion 131 that is warped in a direction opposite to the cooperating direction. The guiding portion 131 includes a first surface 133 facing the mating terminal 21. The first surface 133 is a curved surface. Of course, the first surface 133 can also be designed as a flat inclined surface. The first surface 133 transitions from the rear end of the plastic part 13 to the front end 135 of the plastic part 13 in a direction gradually away from the cooperating direction. The conductive terminal 11 includes a terminal surface 111 facing the cooperating direction. There is a smooth transition between the first surface 133 and the terminal surface 111, and the size of the first surface 133 along the cooperating direction does not exceed the size of the terminal surface 111 at the contact portion 121 along the cooperating direction, so that the contact portion 121 and the mating terminal 21 can effectively contact and cooperate. The guiding portion 131 guides the conductive terminal 11 to mate with the mating terminal 21 when the first connector 2 and the second connector 3 are mated with each other. In the traditional design, the front end portion 123 of the conductive terminal 11 away from the mating direction to guide the conductive terminal 11 and the mating terminal 21 to mated together. However, that also causes a larger gap between the front end portion 123 and the mating terminal 21 after the conductive terminal 11 and the mating terminal 21 are cooperated. In the present invention, the front end portion 123 is molded in the plastic part 13 the guiding portion 131 is arranged on the plastic part 13, and the size of the plastic part 13 in the cooperating direction does not exceed the size of the contact portion 121 in the cooperating direction. While ensuring that the conductive terminal 11 can be guided to connect with the mating terminal 21, it also reduces or even eliminates the gap between the contact portion 121 of the conductive terminal 11 and the mating terminal 21 after mating. The gap between the contact portion 121 and the mating terminal 21 is less than 0.1 mm after mating, which effectively solves the impact of the capacitance effect on impedance matching during high-speed signal transmission.

The mating terminal 21 includes a base 210 held in the second insulating body 5 and a mating end 220 located at the front of the base 210. The mating end 220 includes a contact portion 221 capable of contacting and cooperating with the conductive terminal 11 and a front end portion 223 located at the front end of the contact portion 221. The mating plastic part 23 is disposed on the front end portion 223. The mating plastic part 23 is integrally formed on the front end portion 223. The front end portion 223 is warped from the front end of the contact portion 221 in a direction opposite to the cooperating direction. The mating plastic part 23 includes a guiding portion 231 that is warped in a direction opposite to the cooperating direction. The guiding portion 231 includes a first surface 233 facing the conductive terminal 11. The first surface 233 transitions from the rear end of the mating plastic part 23 in a direction away from the cooperating direction to the front end 235 of the mating plastic part 23. The mating terminal 21 includes a terminal surface 211 facing the cooperating direction. The detailed structure of the mating end 220 of the mating terminal 21 and the mating end 120 of the conductive terminal 11 may be the same structure, which will not be described herein addition, in the present invention, the names of the conductive terminal 11 and the mating terminal 21 are relative.

After the first connector 2 and the second connector 3 are mated, the terminal module 10 is cooperated with the corresponding mating terminal module 20. Compared with the traditional connector, the present invention is provided with a plastic part 13 at the front end of the conductive terminal 11, thereby eliminating or reducing the guiding length of the conductive part of the conductive terminal 11. The gap between the contact portion 121 of the conductive terminal 11 and the mating terminal 21 is reduced as much as possible or even zero, this effectively solves the impact of the capacitance effect on the impedance matching of the connector in the high-speed signal transmission, improves the impedance matching of the connector, and reduces the insertion loss of the connector.

The above is only one of the embodiments of the present invention, but not all or the only embodiments. Any equivalent changes to the technical solutions of the present invention by those skilled in the art by reading the description of the present invention are covered by the claims of the present invention.

What is claimed is:

1. A terminal module comprising:

a conductive terminal to be contacted and cooperated with a mating terminal, the conductive terminal including:

a base; and a mating end at a front of the base, the mating end including:

a contact portion to be contacted and cooperated with the mating terminal; and a front end portion at a front end of the contact portion; and a plastic part, wherein the plastic part is arranged at the front end portion so that a gap between the contact portion of the conductive terminal and the mating terminal is less than 0.1 mm after the conductive terminal is mated to the mating terminal.

2. The terminal module as claimed in claim 1, wherein the plastic part includes a guiding portion warped in a direction opposite to a cooperating direction.

3. The terminal module as claimed in claim 2, wherein the plastic part is integrally formed on the front end portion.

4. The terminal module as claimed in claim 2, wherein the plastic part is assembled on the front end of the contact portion.

5. The terminal module as claimed in claim 3, wherein the front end portion is warped from the front end of the contact portion in a direction opposite to the cooperating direction.

6. A mating assembly comprising:

a terminal module including:

a plastic part; and a conductive terminal including a base and a mating end at a front of the base, the mating end including:

a contact portion; and a front end portion at a front end of the contact portion; and a mating terminal module matched with the terminal module, the mating terminal module including a mating terminal to be contacted and cooperated with the conductive terminal, wherein the plastic part is arranged at the front end portion, so that a gap defined between the contact portion of the conductive terminal and the mating terminal, is less than 0.1 mm after the conductive terminal is mated to the mating terminal.

7. The mating assembly as claimed in claim 6, wherein the conductive terminal comprises an elastic terminal cooperating with the mating terminal by elastic abutment.

8. The mating assembly as claimed in claim 7, wherein a size of the contact portion of the conductive terminal is at least twice a size of the front end portion.

9. The mating assembly as claimed in claim 8, wherein the mating terminal includes a base and a mating end at the front of the base, the mating end of the conductive terminal and the mating end of the mating terminal have substantially same structure.

10. The mating assembly as claimed in claim 9, wherein the mating terminal module includes a mating plastic part, the plastic part is integrally formed on the front end, and the mating plastic part is integrally formed on the front end of the mating terminal.

11. A terminal module comprising:

a conductive terminal to be contacted and cooperated with a mating terminal, the conductive terminal including:

a base; and a mating end at a front of the base, the mating end including:

a contact portion to be contacted and cooperated with the mating terminal;

a front end portion located at a front end of the contact portion and defining a rectangular cross-section with two long sides and two short sides perpendicular to each other wherein the long side defines a main surface and the short side defines a side edge surface of the front end portion; and a plastic part, wherein the plastic part is arranged at the front end portion and forms a step structure to cover only a front region of one main surface and an end face of the front end portion.

12. The terminal module as claimed in claim 11, wherein the plastic part does not cover the side edge surfaces.

13. The terminal module as claimed in claim 11, wherein the plastic part forms a wedge configuration in a side view.

14. The terminal module as claimed in claim 13, wherein the plastic part includes a guiding portion with a curved surface compliantly connecting to the other main surface.

15. The terminal module as claimed in claim 14, wherein the plastic part includes a flat face opposite to the curved surface.

16. The terminal module as claimed in claim 11, wherein the front end portion defines a first thickness along a thickness direction thereof, the plastic part defines a second thickness along said thickness direction, and said second thickness is more than three times of the first thickness.

* * * * *